United States Patent [19]

Krowl

[11] 4,435,933

[45] Mar. 13, 1984

[54] VINYL SIDING ATTACHMENT

[75] Inventor: Thomas R. Krowl, N. Tonawanda, N.Y.

[73] Assignee: National Gypsum Company, Dallas, Tex.

[21] Appl. No.: 291,639

[22] Filed: Aug. 10, 1981

[51] Int. Cl.[3] ..... E04D 1/34; E04D 3/362; E04D 3/363

[52] U.S. Cl. ..... 52/309.1; 52/520; 52/521; 52/522; 52/547; 52/748

[58] Field of Search ..... 52/520, 522, 531, 546, 52/547, 748, 521, 309.1

[56] References Cited

U.S. PATENT DOCUMENTS

| | | | |
|---|---|---|---|
| 3,214,876 | 11/1965 | Mattes | 52/522 X |
| 3,226,901 | 1/1966 | Harter | 52/520 |
| 3,417,531 | 12/1968 | Jones | 52/520 |
| 3,473,274 | 10/1969 | Godes | 52/531 X |
| 3,504,467 | 4/1970 | Hatch et al. | 52/531 |
| 3,552,078 | 1/1971 | Mattes | 52/531 X |
| 3,667,177 | 6/1972 | Biela | 52/461 X |
| 4,102,106 | 7/1978 | Golder et al. | 52/546 X |
| 4,104,841 | 8/1978 | Naz | 52/531 X |

*Primary Examiner*—Alfred C. Perham
*Attorney, Agent, or Firm*—Robert F. Hause

[57] ABSTRACT

Rigid clips, having an upper hanger portion and a lower channel formed to grasp the common elongate protrusions formed along the top edge of extruded vinyl siding, support the siding while permitting it to expand and contract freely with changes in temperature.

10 Claims, 2 Drawing Figures

VINYL SIDING ATTACHMENT

This invention relates to the attachment of thin vinyl siding, and particularly to the use of clips which can be affixed to a structure and inherently provide the desired relatively loose holding of the vinyl siding, permitting freedom of the siding to expand and contract with changes in temperature.

Extruded sections of thermoplastic polyvinyl chloride siding, commonly referred to as vinyl siding, with face sections of about one millimeter thickness, are commonly used as an imitation and substitute for wooden lap siding. One problem that is common with vinyl siding is its tendency to expand and contract with changes in temperature.

As a result it has been a practice to attach vinyl siding by nailing, through nail slots provided, with the nails never driven all the way in. The nails were stopped short, in driving them in, sufficient to permit the siding to move sideways relative to the nails. Ribs are commonly formed in the nailing portion of the siding, having a height which is contacted by a hammer head, when the nail has been driven in far enough, and further driving of the nail becomes undesirable.

Although these nailing ribs are generally effective in reminding an applicator to not drive a fastener in tight against the siding, they are only remainders and are not positive in the prevention of tight fastening. They are not effective in preventing tight fastening when fasteners are applied by power tools, such as a rapid power nailer.

The present invention adds a clip to the structure which is constructed to grasp the nailing portion, along the top edge, of the commonly available forms of vinyl siding, in a way in which no care need be taken regarding providing the ability of the siding to expand and contract relative to the rest of the structure.

It is an object of the invention to provide an improved system for attaching vinyl siding.

It is a further object to provide a means for attaching vinyl siding which inherently always permits freedom of the vinyl siding to expand and contract without distortion.

These and other objects and advantages of the invention will be more readily understood when considered in relation to the preferred embodiments, as set forth in the specification and shown in the drawings, in which.

Figure 1:
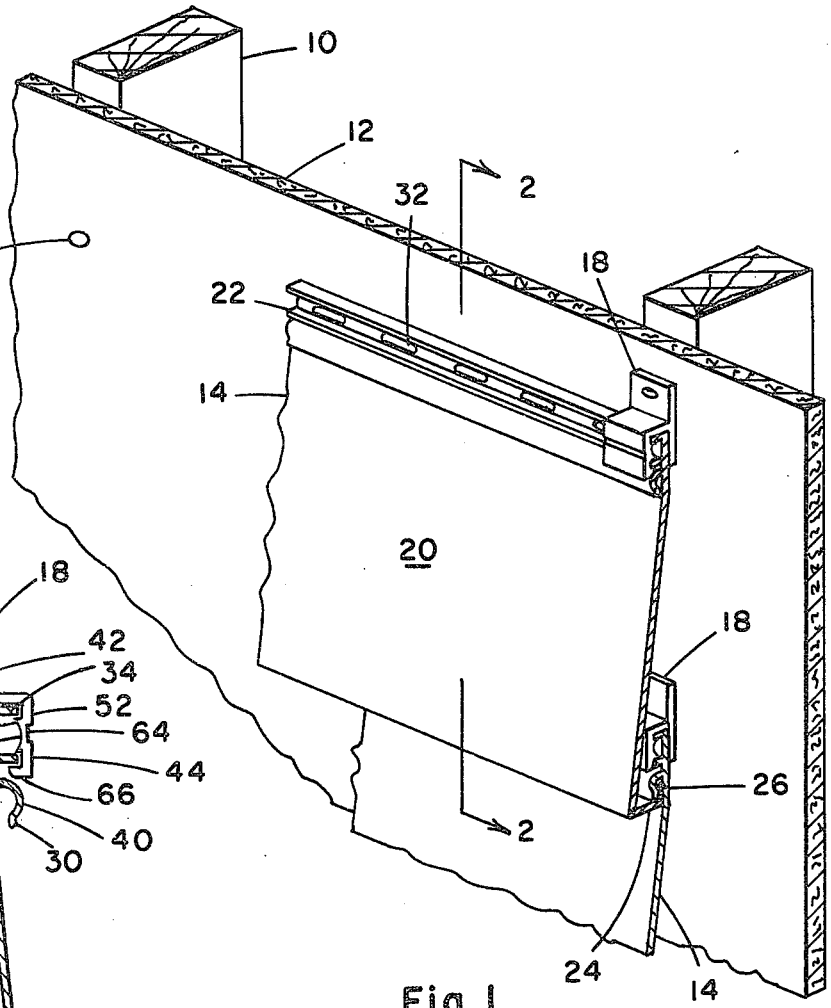
FIG. 1 is an isometric view of two sections of vinyl siding applied to the side of a building in accordance with the invention.
Figure 2:
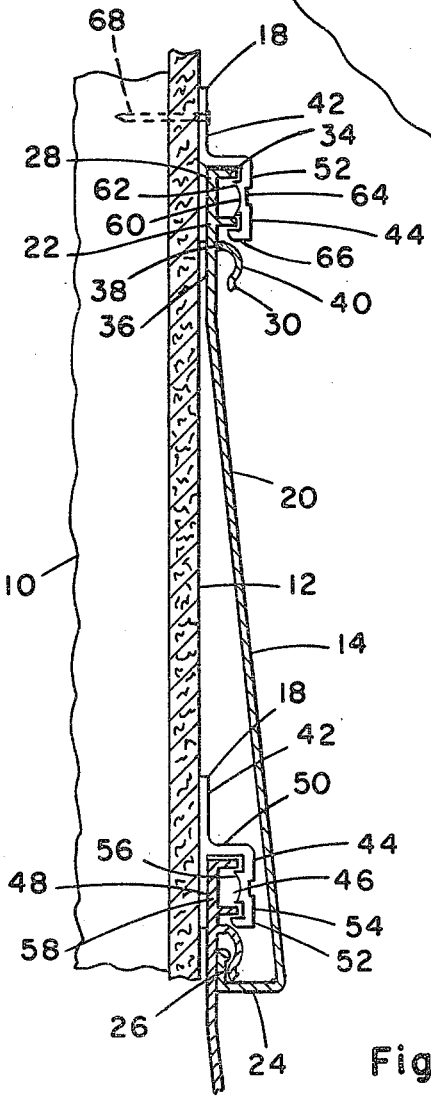
FIG. 2 is an end view of the siding structure of FIG. 1, taken on line 2—2 thereof.

Referring to FIG. 1, there is shown framing members 10, exterior sheathing 12 and two courses of extruded vinyl lap siding 14, which together form the exterior of a building. Sheathing 12 is attached to the framing members 10 with nails 16. Vinyl siding 14 is affixed to the sheathing 12 by clips 18.

Vinyl siding 14 is produced by extruding elongate integral sections of about 10 to 20 feet in length, having a shape to simulate wood lap siding. The siding 14 includes a main face portion 20, a top concealed portion 22 and a bottom perpendicular spacer flange 24 and, at the outermost end thereof, an upwardly extending short interlock flange 26.

The top concealed portion 22 includes an upper attachment portion 28 and a lower interlock receiver channel 30, opening downwardly, for the reception of an interlock flange 26 of the siding section 14 located immediately thereabove. The attachment portion 28 includes a plurality of spaced apart, longitudinally aligned, elongated nailing slots 32. Slots 32 are disposed between two spaced, parallel guide ribs 34, provided to assist an applicator, which nailing, to preventing driving the nail in until it is tight. These commonly available elements for use with the prior common method of nailing on siding will function differently in the present invention, in which the siding 14 is not attached by nails.

The interlock receiver channel 30 is formed of an "h" section, in which the long leg 36 connects the attachment portion 28 to the face 20, and a short horizontal leg 38 and an outer downward leg 40 coact with the long leg 36 to form the downwardly opening channel 30.

Typically, the face portion 20 is about eight to ten inches wide, the long leg 36 is about three-fourths of an inch wide and the attachment portion 28 is about a half inch wide. The nailing slots are about 5/32" wide and one inch long, with a spacing of one inch between adjacent slots.

In accordance with a preferred form of the invention, clip 18 consists of a short section of semirigid plastic extrusion, for example of polyvinyl chloride and having a width of one inch. In an end view of clip 18, it will be seen to consist of a top flat hanger portion 42 of about one inch square, and a bottom complementary channel portion 44, also of about one inch square.

Channel portion 44 has, as seen from an end view, a channel 46 formed extending completely therethrough, from side to side. Channel 46 is formed by a flat back wall 48, a top wall 50 and a contoured front wall 52. Contoured front wall 52 has a centrally depressed exterior face 54 and an interior surface 56 which is contoured to engage the raised portion of the siding top edge including, in the present embodiment, the two guide ribs 34.

In a preferred embodiment, guide ribs 34 are 0.040 inch thick, extend outward 0.075 inch, and are spaced apart 0.5 inch. The back wall 58 of the attachment portion 28 is 0.045 inch thick. The clip front wall 52 and back wall 48 are each 0.875 inch in height, and they are spaced apart 0.22 inch at the two widest portions, where at the guide ribs 34 are located.

Interior surface 56 includes a central inwardly raised section 60 which is 0.375 inch wide and extends into the space between guide ribs 34. Raised section 60 has a concave shape with two inwardmost edges 62, 62. Inwardmost edges 62, 62 are spaced 0.125 inch from back wall 48.

The centrally depressed exterior face 54 of front wall 52 has a shallow groove or depressed area 64 about 0.187 inch wide and 0.062 inch deep centered opposite the concavity of the raised section 60, to coact with the overall structure in permitting limited bending of the front wall 52, for inserting the attachment portion into channel 46.

A raised lip 66 extends inwardly at the bottom of front wall 52, spaced about 0.125 inch from back wall 48.

In the front view of clip 18, seen in FIG. 1, it will be seen the clip is about one inch wide and two inches tall. The clips can be put on the siding by sliding the clips on at one end of a length of siding, or by spreading the channel 46, by bending front wall 52, and inserting the siding top edge upwardly into the channel 46. It is further contemplated that clips 18 can be made available to users in groups, so that a group may be slid onto the end of a section of siding as a unit and separated into individual clips as each is nailed or stapled, such as with nail 68, to a building exterior. If clips 18 are formed by an extrusion process, as the elongate extrusion is slit into individual clips it could be advantageous to not slit completely leaving clips connected together in a manner easily pulled apart, into groups of any desired number.

Clips 18 could also be formed by injection molding, which also could include forming a small, easily severable connected between adjacent clips.

Clips 18 can be located at any position along the siding top edge, such as to overlie, and be firmly attached to the underlying sheathing, at a framing member.

Having completed a detailed description of the preferred embodiments of my invention so that those skilled in the art may practice the same, I contemplate that variations may be made without departing from the essence of the invention.

I claim:

1. In combination, an elongate section of siding and a siding clip for supporting said siding, said clip comprising a back for disposition against a supporting surface, an upper hanger portion suitable for attachment to such a supporting surface, and a lower channel portion, said channel portion having a channel formed extending therethrough from side to side, said channel having internally raised portions disposed for engaging and restricting removal from said channel of non-uniform thickness elements extending along the top portion of said elongate siding section, said siding having a face portion, a top concealed portion, a bottom rearwardly extending spacer flange, and, at the rearward end of said spacer flange, a short interlock flange, said siding concealed portion including an attachment portion having a plurality of spaced apart, longitudinally aligned nailing slots, said slots being disposed between two spaced parallel guide ribs, said attachment portion being disposed within said clip channel and said guide ribs being restricted from removal from said channel by said internally raised portion.

2. The combination of claim 1 wherein said siding is made of an extruded polyvinyl chloride.

3. The method of applying elongate sections of siding and clips as defined in claim 1, comprising the steps of inserting said attachment portion including said two parallel guide ribs into the channel of a plurality of said clips and mechanically fastening said clips one at a time in progressive spaced positions along the exterior of a building.

4. The method of claim 3 wherein said elongate siding section interlock flange is interlocked with a lower previously applied section of siding after inserting said attachment portion into said clips and subsequently fastening said clips to said building.

5. The method of claim 3 wherein said clips are fastened together as a group when placed on said top concealed portion, and are separated each from the balance of the group as each is fastened to said building.

6. The combination of claim 1 wherein said clip channel portion comprises a flat back wall, a top wall and a contoured front wall, said contoured front wall having an internally raised portion with a concave surface disposed along the center thereof.

7. The combination of claim 6 wherein said contoured front wall includes a shallow groove disposed along the center of the exterior surface.

8. The combination of claim 6 wherein said contoured front wall includes an internally raised lip along the bottom thereof engaging the lower of the two guide ribs.

9. The combination of claim 7 wherein said contoured front wall includes an internally raised lip along the bottom thereof engaging the lower of the two guide ribs.

10. The combination of claim 1 wherein a plurality of clips adjoined into a single unit, in readily separable relation, are mounted on said attachment portion of said siding.

* * * * *

UNITED STATES PATENT AND TRADEMARK OFFICE

CERTIFICATE OF CORRECTION

PATENT NO. : 4,435,933

DATED : March 13, 1984

INVENTOR(S) : THOMAS R. KROWL

It is certified that error appears in the above-identified patent and that said Letters Patent are hereby corrected as shown below:

Column 1, line 28, "remainders" should have read ---reminders---.

Column 2, line 7, "which" should have read ---while---; same line, "preventing" should have read ---prevent---.

Column 3, line 13, "connected" should have read ---connection---.

Signed and Sealed this

*Twenty-second* Day of *May 1984*

[SEAL]

*Attest:*

GERALD J. MOSSINGHOFF

*Attesting Officer*

*Commissioner of Patents and Trademarks*